US006717888B2

(12) United States Patent
Wilmore

(10) Patent No.: US 6,717,888 B2
(45) Date of Patent: Apr. 6, 2004

(54) TIMER ACTUATED BY A BURNING INCENSE STICK

(76) Inventor: David C. Wilmore, 7541 Claremont Ave., Berkeley, CA (US) 94705

( * ) Notice: Subject to any disclaimer, the term of this patent is extended or adjusted under 35 U.S.C. 154(b) by 141 days.

(21) Appl. No.: 10/150,041

(22) Filed: May 16, 2002

(65) Prior Publication Data

US 2003/0214884 A1 Nov. 20, 2003

(51) Int. Cl.[7] ..... G04B 47/00; G04B 23/02; G04F 1/00

(52) U.S. Cl. ..... 368/12; 368/97; 368/244

(58) Field of Search ..... 368/10, 12, 97, 368/107–109, 244

(56) References Cited

U.S. PATENT DOCUMENTS 4,324,763 A * 4/1982 Jarman ..... 422/116
4,679,943 A * 7/1987 Kavoussi et al. ..... 368/12
5,873,370 A * 2/1999 Towle et al. ..... 131/190

* cited by examiner

*Primary Examiner*—Vit W. Miska
(74) *Attorney, Agent, or Firm*—Bruce H. Johnsonbaugh

(57) ABSTRACT

A timer is provided which is actuated by an incense stick burning to a given point at which point a pivotally movable hammer is released. When the hammer is released, it moves from its first retracted position to a second position in response to gravitational forces wherein it strikes a bowl to make a pleasant alarm sound. The timer is particularly useful and appropriate when used in conjunction with meditation or a similar exercise.

9 Claims, 6 Drawing Sheets

TIMER ACTUATED BY A BURNING INCENSE STICK

BACKGROUND AND BRIEF SUMMARY

The present invention relates generally to a timer mechanism. More particularly, the present invention provides a timer mechanism actuated by a burning incense stick. When the incense stick has burned past a given point, a pivotally mounted hammer is released and allowed to strike a bowl to make a pleasant sound. The timer is particularly useful and appropriate when used in conjunction with meditation, but it may be used for other purposes as well.

The prior art includes incense burning apparatus as shown in U.S. Pat. No. 4,324,763 wherein a series of timer discs on a common shaft is rotated by an electric motor and the rim of each disc is provided with a bore for holding an incense stick. This patent does not teach the use of an individual incense stick to actuate an alarm when the stick has burned to a given point.

The prior art also includes incense stick holders such as shown in U.S. Pat. No. 5,873,370. However, that patent does not teach the triggering of an alarm as the incense stick burns to a given point.

The prior art also includes an ancient "dragon boat" alarm. The "dragon boat" has a silk thread carrying bronze bells at each end and the center of the silk thread is draped over the elevated dragon boat. An incense stick is placed next to the silk thread. When the burning incense stick reaches and burns through the silk thread, the bronze bells fall into a metal pan beneath the dragon boat. The dragon boat is more complicated than the present invention in that the user must reassemble the bronze bells with a new silk thread and drape the new thread over the dragon boat in order to reset the device. Also, the dragon boat design uses the burning property of the incense to burn through another element of the timer (namely, the silk thread) causing a release. In the present design, the incense acts as a physical support for the hammer and its burning removes this support, allowing the hammer to release and strike the bowl.

The present invention provides an easily resettable alarm actuated by a burning incense stick. The present invention also provides a pivotally mounted hammer which is held in its retracted position by an incense stick and, when the incense stick burns past a given point, the hammer is released and gravity causes the hammer to rotate and to strike a bowl, thereby causing a pleasant noise. The timer may be easily reset by simply inserting a new incense stick and resetting the hammer.

A primary object of the present invention is to provide a timer actuated by an incense stick burning to a given point on the stick, at which point a hammer is released and causes a pleasant alarm noise by striking a bowl.

A further object of the invention is to provide an easily resettable incense timer appropriate for use with meditation or other activities.

Another object of the invention is to provide an incense timer having a simple and cost effective design, but which is reliable and produces a pleasant alarm noise.

Further objects and advantages of the invention will become apparent from the following description and drawings wherein:

DETAILED DESCRIPTION OF THE DRAWINGS

Figure 1:
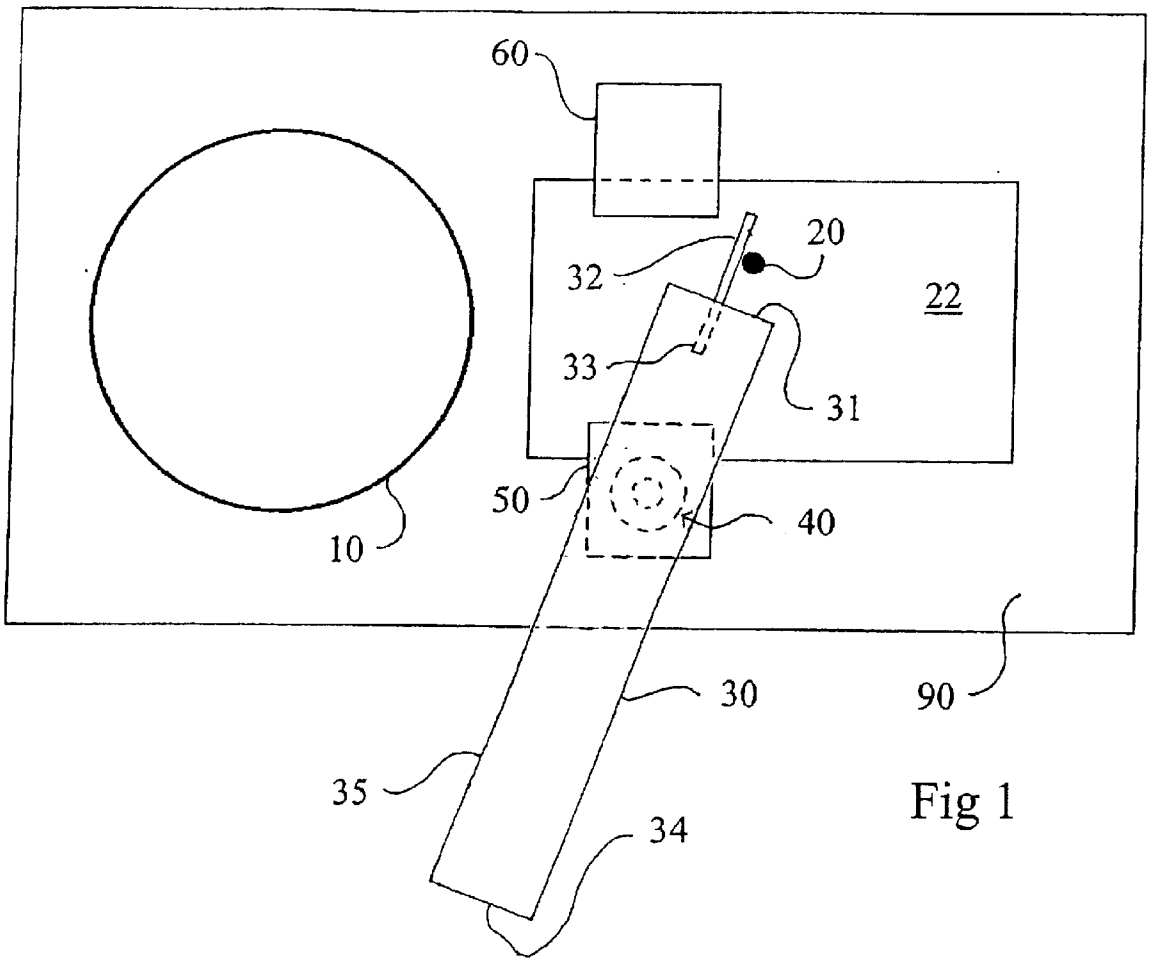
FIG. 1 is a plan view of the invention wherein the hammer is shown in its retracted or cocked position.
Figure 2:
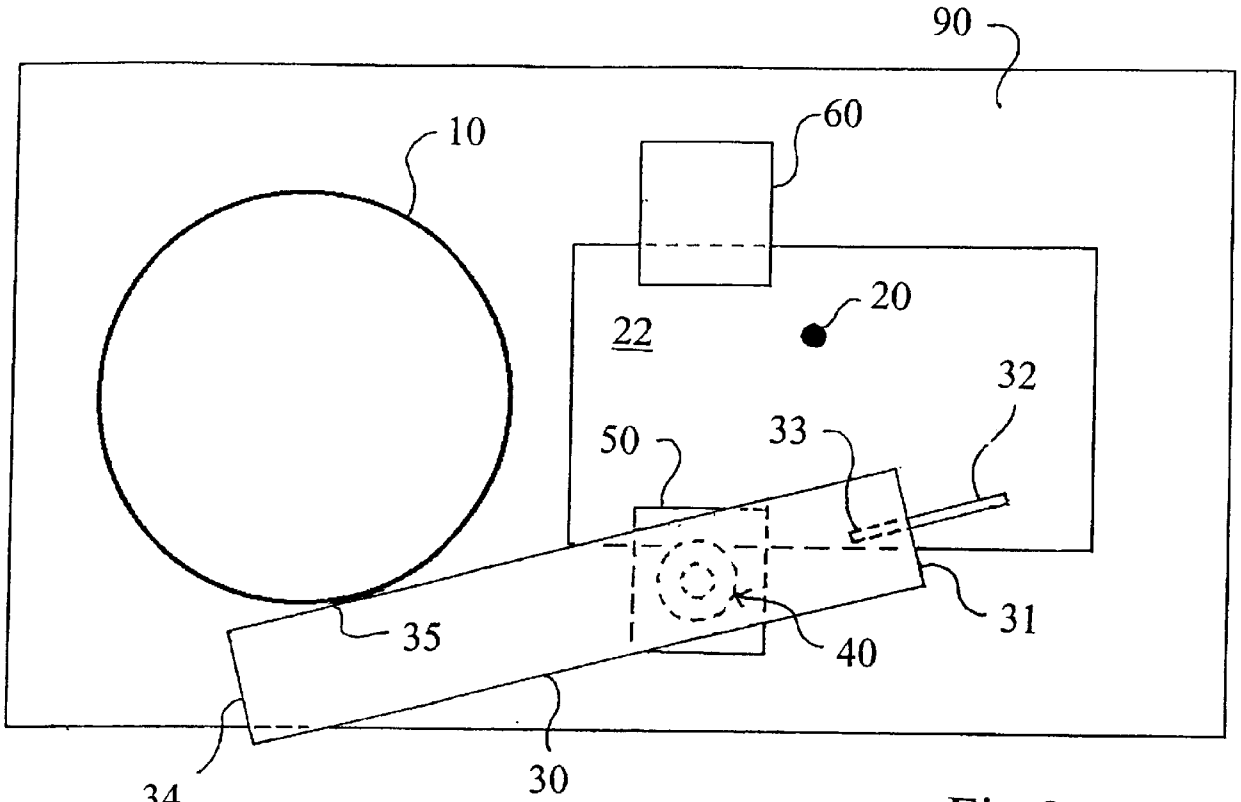
FIG. 2 is a plan view of the timer shown in FIG. 1 wherein the incense stick has burned past a given point, the hammer has been released and is shown in FIG. 2 as it strikes the bowl, causing a pleasant alarm noise.

FIGS. 1–4 illustrate a first embodiment of the invention wherein a metallic bowl 10 is provided and incense stick 20 is oriented on a vertical axis. However, it is understood that incense stick 20 could be mounted on an inclined axis as well. Incense stick 20 is carried by a holder 22 which is a generally rectangular shaped piece of ceramic or other suitable material carried by a recess 23 (FIG. 3) formed in hammer support stands 50 and 60.

Hammer 30 may be made of different materials but wood is the preferred material. The first end 31 of hammer 30 carries a metallic rod 32 in a cylindrical bore 33. The second end 34 rotates toward bowl 10 when hammer is released and strikes bowl 10 with side surface 35 near second end 34.

Figure 3:
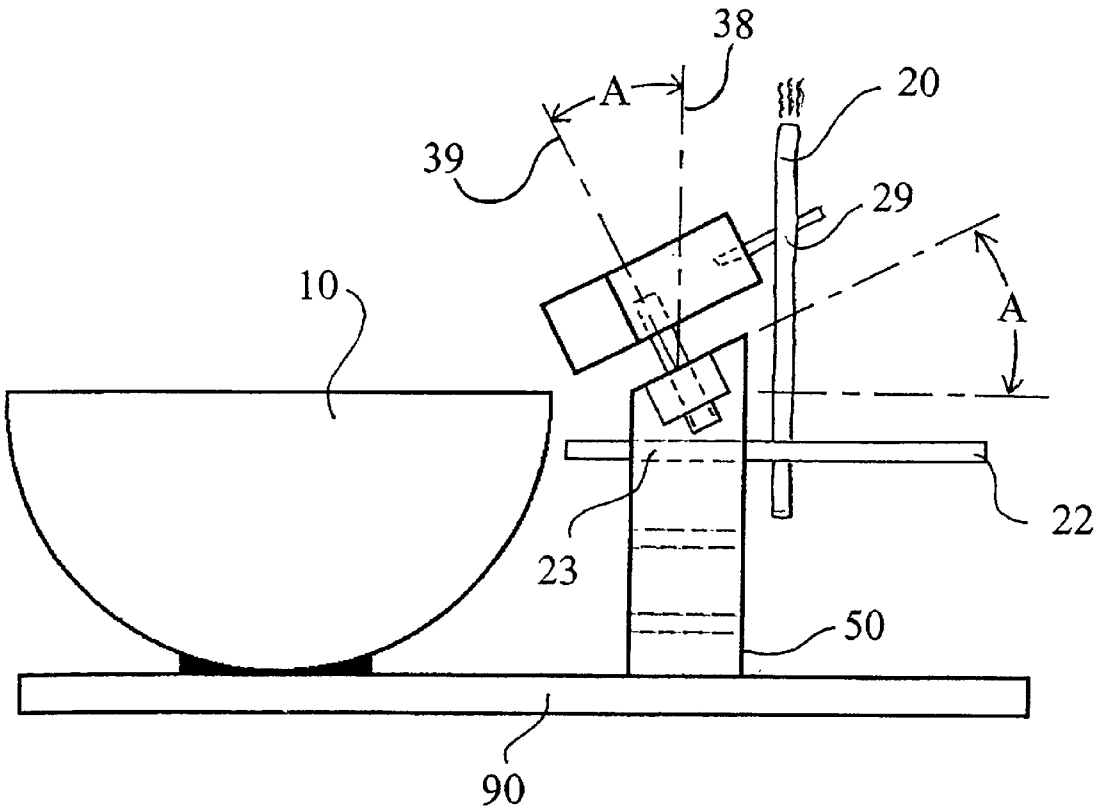
FIG. 3 is a side elevational view, showing the timer illustrated in FIGS. 1 and 2, wherein the hammer is in its retracted position shown in FIG. 1.
Figure 4:
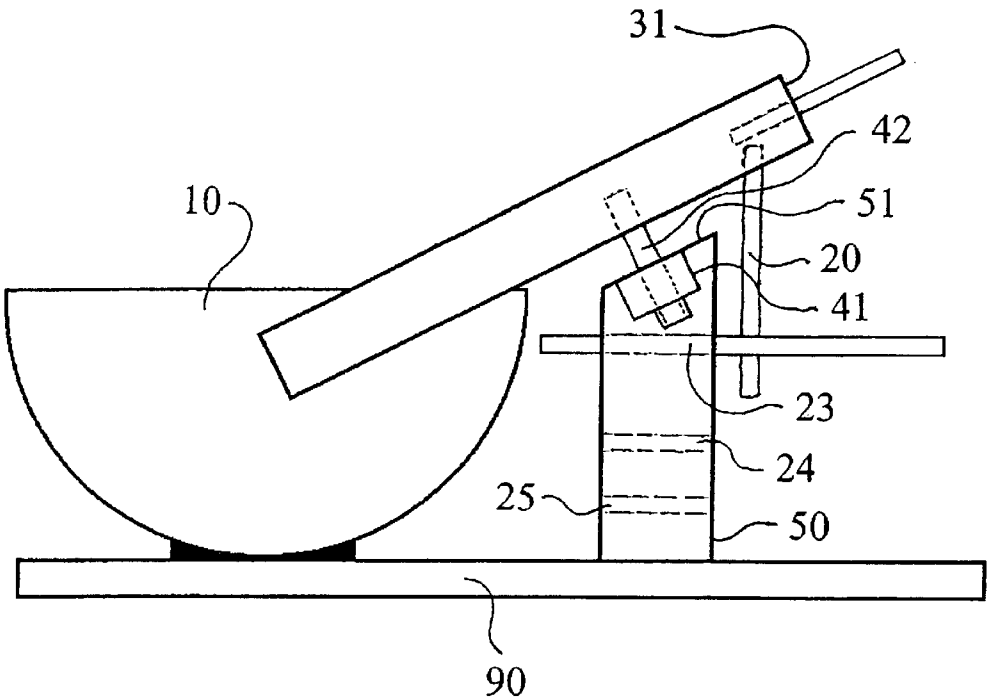
FIG. 4 is a side elevational view of the timer illustrated in FIG. 3 wherein the hammer is shown as it strikes the bowl.

Mounting means 40 is shown best in FIGS. 3 and 4 and includes hammer support stand 50 and inclined upper surface 51 of hammer support stand 50, bearing 41 carried by upper surface 51 and pin 42 carried by bearing 41 and extending into and fixedly attached to hammer 30. Upper surface 51 is inclined at angle A to the horizontal. Hammer 30 is mounted to pin 41 at a point slightly closer to first end 31 so that the second end 34 is urged by gravitational forces to move towards bowl 10 as the hammer becomes free to rotate. Several recesses 23, 24 and 25 are formed in hammer support stands 50 and 60 to provide different heights for incense stick holder 22 to achieve different lengths of time before the incense stick 20 burns to a given point 29 (FIG. 3) at which point the hammer 30 becomes released. By positioning the incense support plate 22 higher on hammer support stand 50, more time elapses before a given incense stick burns to given point 29 to sound the alarm.

After hammer 30 strikes bowl 10 to make the pleasant alarm noise, it is easily reset. The user simply removes the burned incense stick 20 from incense stick holder 22, rotates hammer 30 back to its first, retracted or cocked position shown in FIG. 1, and inserts a new incense stick in incense stick holder 22.

As shown in FIG. 3, hammer 30 rotates on an axis 39 which forms an angle A with vertical axis 38. Angle A ranges from 5° to 90°, but the preferred angle is 20°.

Figure 5:
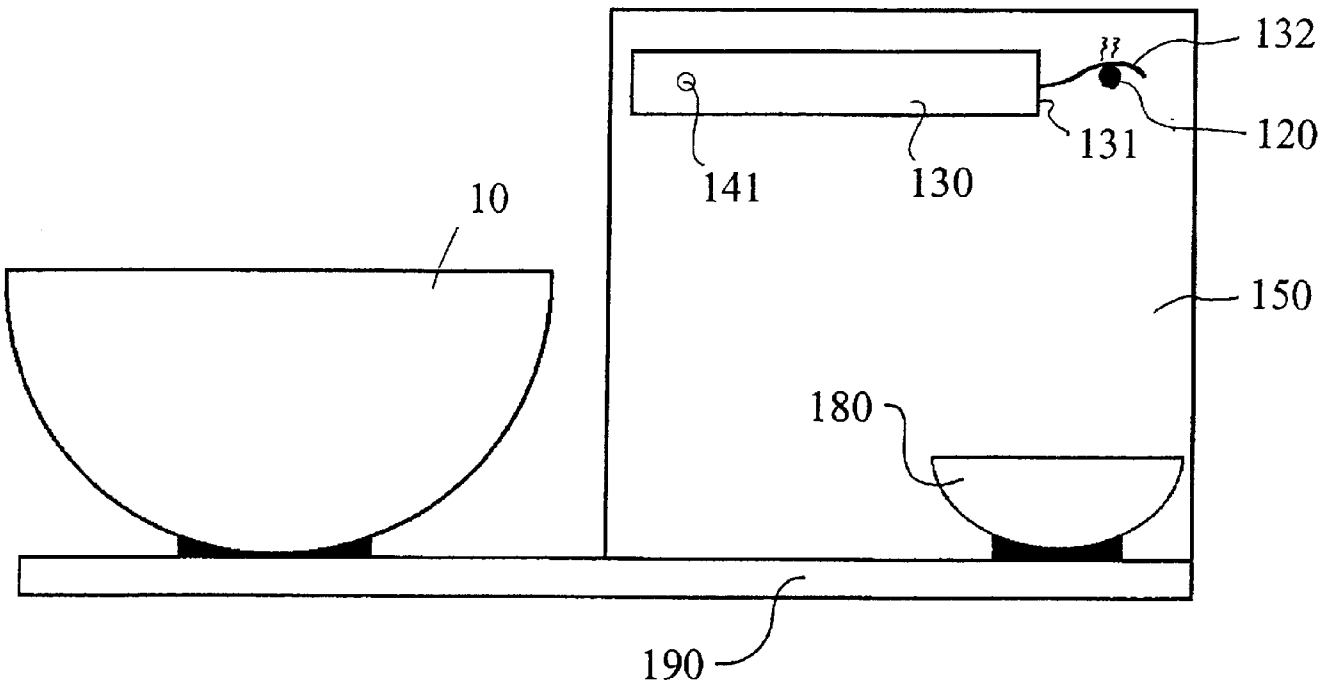
FIG. 5 is a side elevational view showing a second embodiment of the invention wherein the hammer is shown in its retracted or cocked position.
Figure 6:
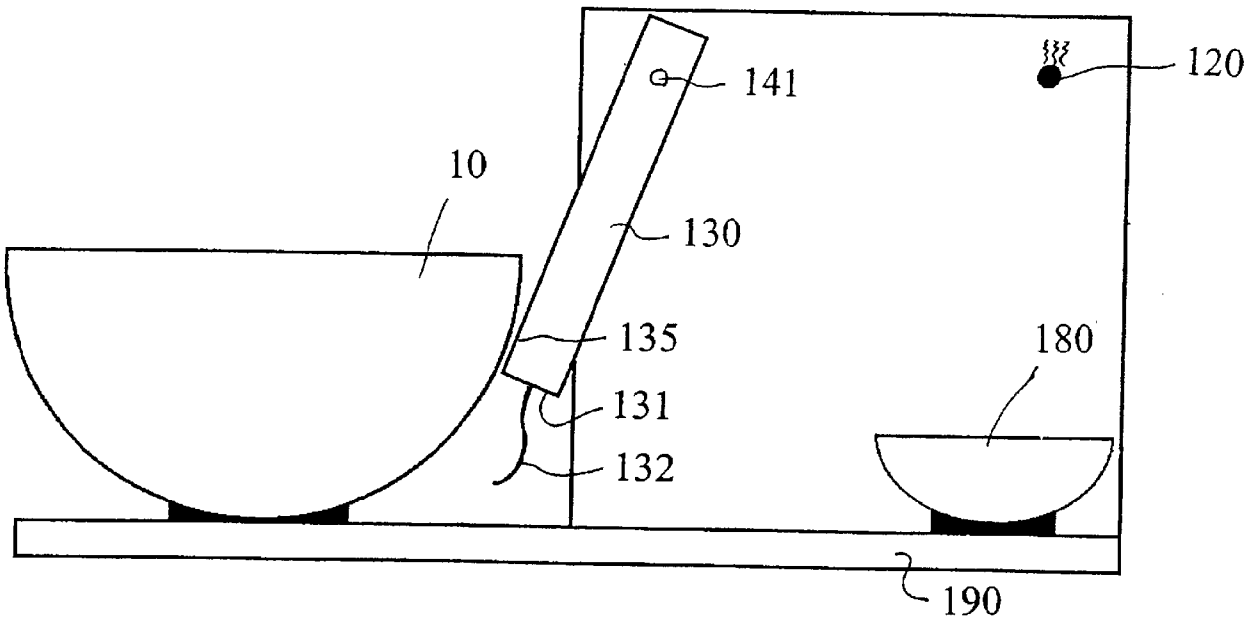
FIG. 6 is a side elevational view showing the timer of FIG. 5 wherein the incense stick has burned to a given point, the hammer has been released and is about to strike the bowl to cause the pleasant alarm noise.

FIGS. 5 and 6 illustrate an alternate form of the invention wherein bowl 10 is struck by hammer 130. Hammer 130 is mounted pivotally on a horizontal axis by elongated pin 141 which is carried by hammer support stand 150. Elongated pin 141 lies on an axis parallel with incense stick 120, and elongated pin 141 is longer than incense stick 120. Base 190 carries bowl 10 and hammer support stand 150. The first end 131 of hammer 130 carries a metallic rod 132 which may have a slight bend formed in it. Rod 132 is supported in its retracted position, shown in FIG. 5, by incense stick 120 which is mounted in a hole in support stand 150 on a horizontal axis parallel to the longitudinal axis on which elongated pin 141 lies. As incense stick 120 burns to a given point along its length, rod 132 is released and hammer 130 moves by gravity to its second position shown in FIG. 6 where side surface 135 is about to contact bowl 10. Hammer 130 may be placed at different locations along the length of elongated pin 141 in order that rod 132 rests at different points along incense stick 120 to allow variations in time before the alarm is sounded after the incense stick starts to burn. An ash collecting trough 180 is carried by support base 190 and extends lengthwise in the same direction as incense stick 120 and collects ashes dropped by the burning incense stick 120. Hammer 130 comes to rest in a vertical position after striking bowl 10.

Bowl 10 is preferably metal and hammer 30 is preferably wood. Rod 132 and pin 141 are preferably metal, but alternate materials may be used.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A timer actuated by an incense stick burning to a given point at which point the timer mechanism is actuated and an alarm making a pleasant noise is sounded, comprising:

a bowl, an incense stick, and a hammer movable between first and second positions, wherein said hammer is supported in said first position at a given point on said incense stick, and wherein said hammer in said first position is retracted relative to said bowl, and as said incense stick burns past said given point, said incense stick no longer provides support to said hammer and said hammer is released and moves to said second position wherein it strikes said bowl to make a pleasant sound.

2. The apparatus of claim 1 wherein said hammer moves from said first position to said second position by gravity.

3. The apparatus of claim 2 wherein said hammer is pivotally carried by a mounting means whereby it rotates on an axis inclined at an angle A relative to a vertical axis.

4. The apparatus of claim 3 wherein said angle A is between 5° and 90°.

5. The apparatus of claim 3 wherein said mounting means comprises:

a hammer support stand, said support stand having an upper surface inclined at angle A relative to a horizontal axis, a bearing carried by said upper surface, and a pin carried by said bearing, and wherein said hammer is pivotally mounted on said pin.

6. The apparatus of claim 2 wherein said hammer is pivotally supported on a first horizontal axis and said incense stick is mounted on a second horizontal axis parallel to said first horizontal axis.

7. The apparatus of claim 6 wherein said hammer is made of wood and carries a metallic rod at one end, said metallic rod contacting said incense stick.

8. The apparatus of claim 6 further comprising an ash collection trough positioned beneath said incense stick.

9. The apparatus of claim 6 wherein said first horizontal axis is an elongated pin having a length greater than said incense stick, and wherein said hammer is movable along said first horizontal axis to vary the time elapsed before the alarm is sounded.

* * * * *